US006618012B1

(12) United States Patent
Louzir et al.

(10) Patent No.: US 6,618,012 B1
(45) Date of Patent: Sep. 9, 2003

(54) DEVICE FOR TRANSMITTING AND/OR RECEIVING SIGNALS

(75) Inventors: Ali Louzir, Rennes (FR); Philippe Minard, Rennes (FR); Jean-François Pintos, Pacé (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/980,551

(22) PCT Filed: Jun. 21, 2000

(86) PCT No.: PCT/FR00/01707

§ 371 (c)(1),
(2), (4) Date: Dec. 3, 2001

(87) PCT Pub. No.: WO00/79649

PCT Pub. Date: Dec. 28, 2000

(30) Foreign Application Priority Data

Jun. 21, 1999 (FR) ..... 99 07827

(51) Int. Cl.[7] ..... H01Q 1/38

(52) U.S. Cl. ..... 343/700 MS; 343/815; 343/834; 343/895

(58) Field of Search ..... 343/700 MS, 702, 343/815, 817, 818, 833, 834, 895; H01Q 1/38

(56) References Cited

U.S. PATENT DOCUMENTS 4,031,537 A 6/1977 Alford ..... 343/704
5,220,334 A * 6/1993 Raguenet et al. .... 343/700 MS
5,381,157 A * 1/1995 Shiga ..... 343/700 MS
5,434,580 A * 7/1995 Raguenet et al. .... 343/700 MS
5,892,483 A * 4/1999 Hayes et al. ..... 343/729
5,986,616 A * 11/1999 Edvardsson ..... 343/853
6,150,984 A * 11/2000 Suguro et al. ..... 343/702
6,229,488 B1 * 5/2001 Lin et al. ..... 343/700 MS

FOREIGN PATENT DOCUMENTS

GB 2226186 6/1990 ..... H01Q/19/13

OTHER PUBLICATIONS

F.S. Lomaglio et al "Original Parasitic Elements for Cross–Polarization Control in Reflector Antennas" International Symposium on Antennas and Propagation, IEEE, May 7, 1990 pp. 164–167.

* cited by examiner

*Primary Examiner*—Tho G. Phan
(74) *Attorney, Agent, or Firm*—Joseph S. Tripoli; Kuniyuki Akiyama

(57) ABSTRACT

The present invention relates to a device for transmitting and/or receiving electromagnetic waves comprising at least one radiating element for radiating a circular polarization of given sense, characterized in that it comprises at least one means dimensioned and positioned with respect to the radiating element in such a way as to radiate, at the frequency of the radiating element, a circular polarization of opposite sense to that of the radiating element so as to compensate for the cross component of the radiating element. The invention applies more particularly to printed antennas operating under circular polarization.

7 Claims, 6 Drawing Sheets

DEVICE FOR TRANSMITTING AND/OR RECEIVING SIGNALS

This application claims the benefit, under 35 U.S.C. § 365 of International Application PCT/FR00/01707, filed Jun. 21, 2000, which was published in accordance with PCT Article 21(2) on Dec. 28, 2000 in French and which claims the benefit of French patent application No. 9907827 filed Jun. 21, 1999.

FIELD OF THE INVENTION

The present invention relates to a device for transmitting and/or receiving electromagnetic waves, more especially to an antenna known as a "printed antenna".

BACKGROUND INFORMATION

In everything that follows, the term "printed antenna" (or "microstrip antenna") will refer to an antenna made using so-called "microstrip" technology comprising a radiating element, typically a "patch", a slot, etc., or an array of such elements, the number of elements depending on the sought-after gain. This type of antenna is used in particular as primary source at the focus of a lens or of a parabola.

By virtue of their lightness, their flatness, the flexibility of design which they offer, their ease of incorporation into numerous items of electronic equipment, the compatibility of their manufacture with proven techniques for the mass production of printed circuits and finally their low cost price, printed antennas are becoming increasingly used in numerous wireless communications systems (local wireless networks, access networks whether they be terrestrial or satellite, etc.).

Now, in numerous applications, it may be advantageous and/or necessary to use circular polarization for the transmission/reception antennas.

However, printed antennas are better adapted to transmit/receive a linearly polarized wave.

Thus, to transmit/receive circular polarization with printed antennas, several techniques have been implemented. These techniques are described, for example, in "Handbook of Microstrip Antennas" edited by J R James & P S Hall; published by: Peter Peregrinus Ltd, London, United Kingdom-ISBN 0 86341 150 9. In particular, chapter 4: Circular polarisation and bandwith, pp. 219–274.

These techniques consist essentially in simultaneously exciting two linearly polarized waves 90° out of phase. Therefore, the quality of the circular polarization which can be quantified by the ellipticity ratio (or "axial ratio") of the wave radiated or received by the antenna can only be obtained over a narrow frequency band.

Solutions for widening the frequency band such as the use of a hybrid coupler associated with a radiating element or the use of the technique of sequential rotation in the case of an array (see "application of sequential feeding to wide bandwith, circularly polarised microstrip patch arrays" P. S. Hall, IEE Proceedings, Vol. 136, Pt. H, No 5, October 1989) make it possible to widen this frequency band.

However, it is not always possible to implement these solutions.

Moreover:

- for certain applications, the bandwidths obtained with these techniques remain inadequate,
- in the case of the use of sequential rotation, the quality of the circular polarization deteriorates fairly rapidly as soon as one deviates from the principal direction of the beam. This poses a problem, for example, for a source antenna used for the illumination of a parabola or a lens.

SUMMARY

The object of the invention is to propose a device for receiving and/or transmitting signals comprising a printed antenna of high quality of circular or linear polarization over a widened frequency band and over a wide angle sector.

Thus, the subject of the present invention is a device for transmitting and/or receiving electromagnetic waves comprising at least one radiating element for radiating a circular or linear polarization of given sense, characterized in that it comprises at least one means dimensioned and positioned with respect to the radiating element in such a way as to radiate, at the frequency of the radiating element, a circular or linear polarization of opposite sense to that of the radiating element and whose phase is adjusted so as to compensate for the cross component of the radiating element.

BRIEF DESCRIPTION OF THE DRAWINGS

According to a preferred embodiment, the means dimensioned and positioned with respect to the radiating element in such a way as to radiate, at the frequency of the radiating element, a circular or linear polarization of opposite sense to that of the radiating element and whose phase is adjusted so as to compensate for the cross component of the radiating element consists of a radiating element of the travelling wave type such as a dielectric rod or a helix associated with polarizers.

Further characteristics and advantages of the present invention will become apparent on reading the description of various embodiments, this description being given with reference to the herein appended drawings in which.

DESCRIPTION OF THE PREFERRED EMBODIMENTS

In the figures, to simplify the description, the same elements bear the same references. Moreover, the present invention will be described while referring to an antenna comprising a radiating element such as a "patch" or an array of "patches". However, it is obvious to the person skilled in the art that the present invention can be applied to all types of printed antennas, namely antennas in which the radiating elements can also consist of a slot, an array of slots, a dipole or an array of dipoles, etc. Moreover, in the description, FIGS. 1 to 6 relate to a printed antenna adapted for transmitting/receiving right or left circular polarization while the embodiment of FIG. 7 relates to a printed antenna whose radiating elements can receive circular polarization or linear polarization.

Figure 1A:
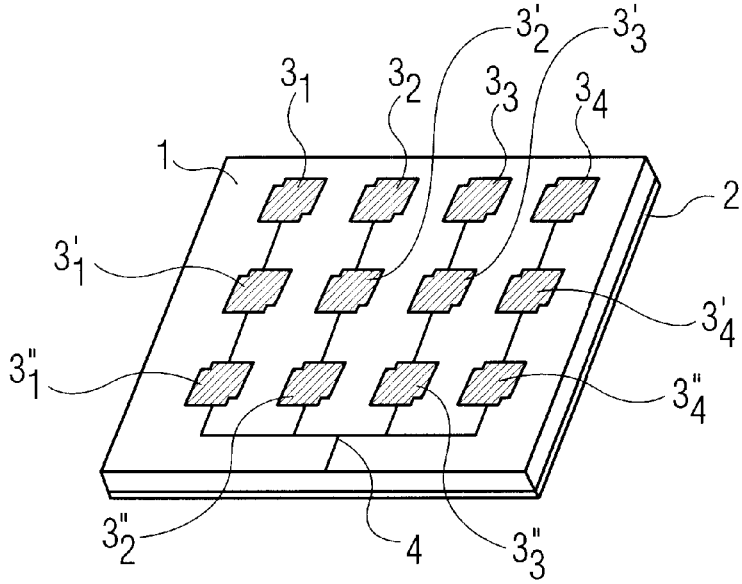
FIG. 1a PRIOR ART
FIG. 1*a* and FIG. 1*b* are diagrammatic views in perspective of an array of a printed antenna consisting of an array of "patches" respectively according to the prior art and according to an embodiment of the present invention, FIG. 2 diagrammatically shows the total radiated field resulting from the radiation of the printed antenna and the helix, this total field being decomposed on an orthogonal basis consisting of the right and left circular polarizations.

Represented in perspective in FIG. 1*a* is an embodiment of a printed antenna which can receive means in accordance with the present invention. More specifically, on a substrate 1 of given permittivity whose lower face is covered with a metal layer 2 forming an earth plane, has been made an array of n "patches", more particularly an array comprising four parallel branches of three "patches" $\mathbf{3}_1$, $\mathbf{3'}_1$, $\mathbf{3''}_1$, $\mathbf{3}_2$, $\mathbf{3'}_2$, $\mathbf{3''}_2$, $\mathbf{3}_3$, $\mathbf{3'}_3$, $\mathbf{3''}_3$, $\mathbf{3}_4$, $\mathbf{3'}_4$, $\mathbf{3''}_4$ mounted in series, the assembly being connected to a feed array referenced 4, produced using microstrip technology.

Figure 1B:
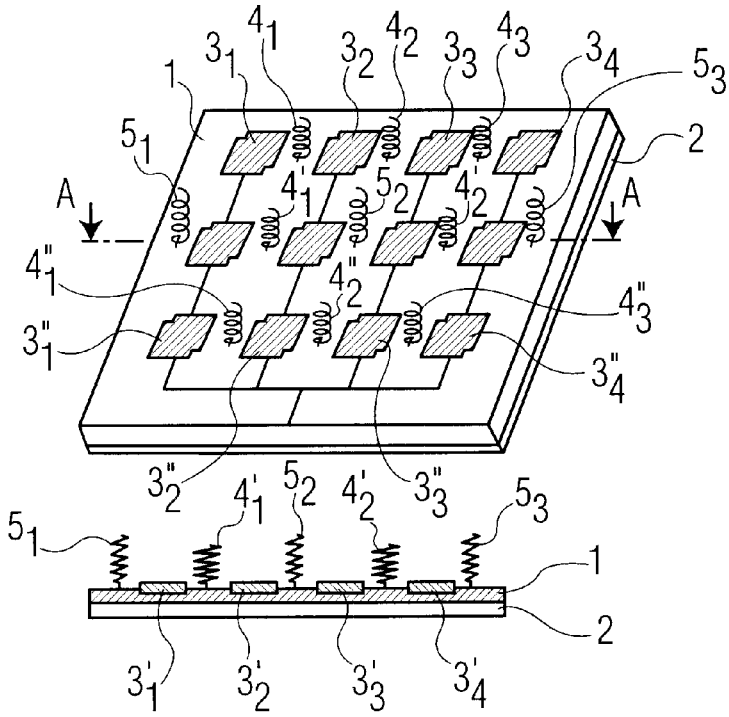

In a known manner, the "patches" are designed and fed so as to radiate and/or receive a circularly polarized wave. However, in this case, the printed antenna thus produced radiates an imperfect circular polarization of given sense, as will be explained with reference to FIG. 2. Also, in accordance with the present invention and as represented in FIG. 1*b*, to improve the circular polarization, there are provided near to the array of "patches", means dimensioned and positioned with respect to the array of "patches" in such a way as to radiate at the frequency of the array of "patches", a circular polarization of opposite sense to that of the array of "patches" so as to compensate for the cross component of the radiating element. These means will hereinafter be referred to as compensating means. Thus, as represented in FIG. 1*b*, there are provided radiating elements of the travelling wave type, more especially helices $\mathbf{4}_1$, $\mathbf{4}_2$, $\mathbf{4}_3$, $\mathbf{5}_1$, $\mathbf{4'}_1$, $\mathbf{5}_2$, $\mathbf{4'}_2$, $\mathbf{5}_3$, $\mathbf{4''}_1$, $\mathbf{4''}_2$, $\mathbf{4''}_3$ which are planted, as shown in the section AA, in the substrate 1 and are not connected to an excitation array.

It is known to the person skilled in the art that a correctly dimensioned helix operates in axial mode and receives or transmits circular polarization naturally. The sense of this circular polarization (left or right) depends on the sense in which the helix is wound.

Figure 2:
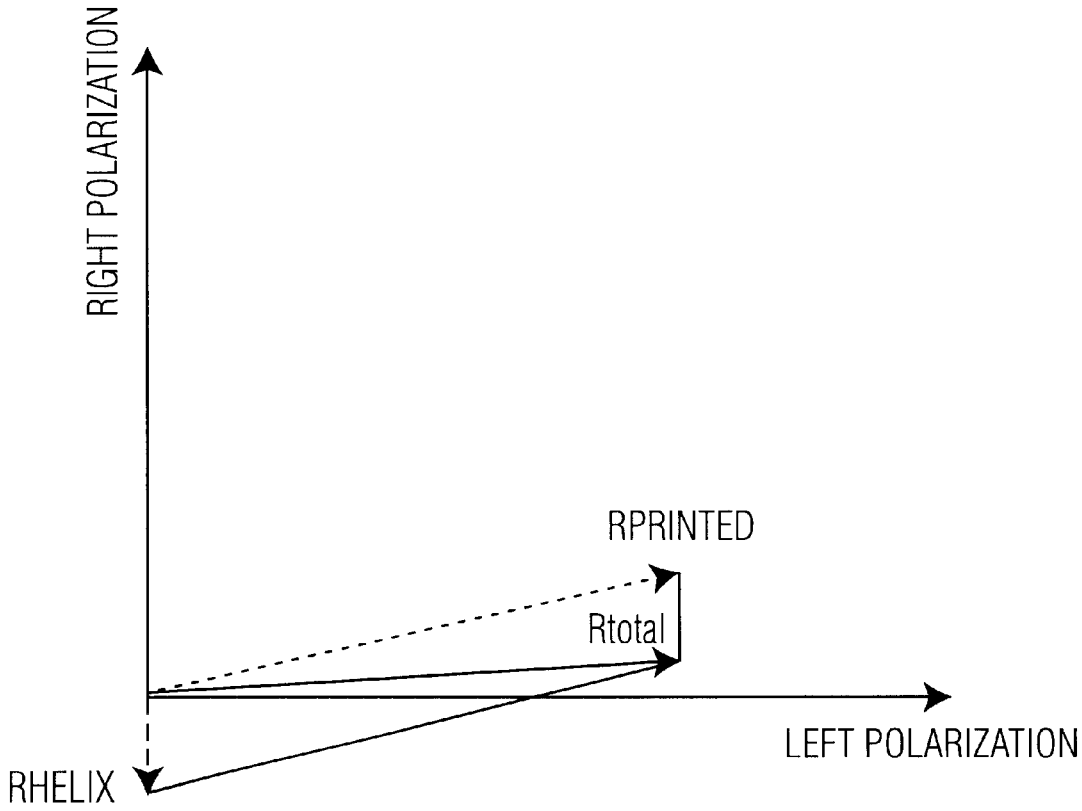

Within the framework of the present invention, it is important for the assembly of helices or other radiating elements of the travelling wave type giving a circular polarization to exhibit a radiation pattern substantially equivalent to the radiation pattern of the array of "patches". Consequently, various processes may be used to calculate the radiation pattern of the array of helices used as compensating means. Thus, the simplest process consists in connecting the array of helices having a circular polarization inverse to that radiated by the array of "patches", to an excitation circuit and in tailoring the characteristics of the helices in such a way as to obtain a radiation pattern identical to the radiation pattern of the array of "patches" to be compensated. Thereafter, in order for the radiation of the helix to oppose the cross component radiated by the array of "patches", its phase must be adjusted by rotating the helices around their axes. The compensation obtained by using a helix is represented in FIG. 2. In this figure, Rprinted represents the field radiated by a printed antenna consisting of the array of "patches" alone. This radiated field exhibits an undesired cross component. This cross component radiated by the printed antenna excites the array of helices which in turn radiates a field Rhelix whose phase is adjusted by rotating the helix about its axis in such a way that it fully or partly opposes the cross component of the printed antenna, thus improving the purity of the circular polarization radiated by the printed antenna. Indeed, the field radiated in the presence of the helix is such that Rtotal=Rprinted+Rhelix as represented in FIG. 2.

Figure 3A:
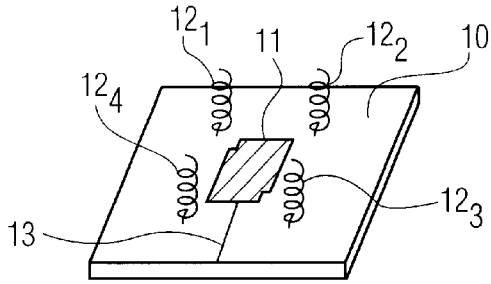
FIGS. 3*a* to 3*e* are diagrammatic perspective views of various embodiments of the present invention.

Various embodiments of a device in accordance with the present invention will now be described with reference to FIGS. 3*a* to 3*e*. As represented in FIG. 3*a*, a radiating element of a printed antenna consisting of a "patch" 11 has been made on a substrate 10. In accordance with the present invention, in this case the compensating means consist of an array of four helices $\mathbf{12}_1$, $\mathbf{12}_2$, $\mathbf{12}_3$, $\mathbf{12}_4$ planted in the substrate. As explained above, the radiation pattern of the helices $\mathbf{12}_1$, $\mathbf{12}_2$, $\mathbf{12}_3$, $\mathbf{12}_4$ has been simulated, by connecting just the helices to an excitation array, and the helices have been designed in a known manner, such that their radiation pattern is equivalent to the radiation pattern of the "patch" and that their polarization is opposite to that of the array of patches. Thereafter, the helices $\mathbf{12}_1$, $\mathbf{12}_2$, $\mathbf{12}_3$, $\mathbf{12}_4$ have been rotated about their axis in such a way that their radiation opposes the cross component radiated by the "patch". Moreover, in a known manner, the "patch" 11 is connected by the line 13 made in microstrip technology to a feed circuit of known type.

Figure 3B:
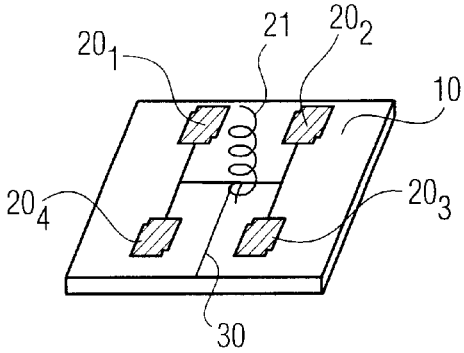

Represented in FIG. 3*b* is another embodiment of the printed antenna, namely an array of four "patches" $\mathbf{20}_1$, $\mathbf{20}_2$, $\mathbf{20}_3$, $\mathbf{20}_4$ connected to a feed circuit of known type. Thus, the "patch" $^{20}$, is connected to the "patch"$\mathbf{20}_4$ by a microstrip line and the "patch" $\mathbf{20}_2$ is connected to the "patch" $\mathbf{20}_3$ by another microstrip line, the two lines being linked together and to the output of the feed circuit 30. In this case, in accordance with the present invention, the compensating means consists of a helix 21 positioned at the centre of the array of the four "patches". This helix is dimensioned and rotated about its axis using the same principles as mentioned above.

Figure 3C:
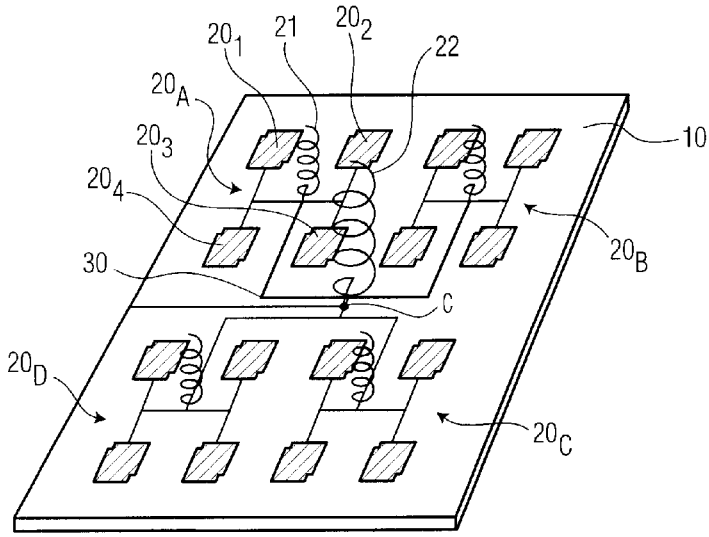
Figure 3D:
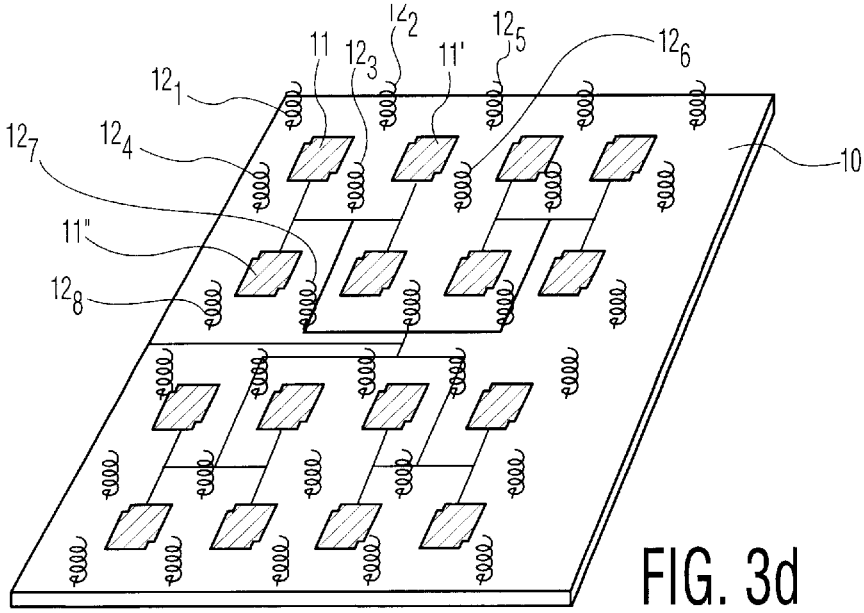

Represented in FIG. 3*d* is another embodiment of the present invention. In this case, the printed antenna consists of four arrays of four "patches" of the type of that described in FIG. 3*b*. In the embodiment of FIG. 3*d*, the cross component of each "patch" is compensated by helices positioned at the four corners of the "patch". More specifically and as represented in FIG. 3*d*, the "patch" 11 is surrounded by helices $\mathbf{12}_1$, $\mathbf{12}_2$, $\mathbf{12}_3$, $\mathbf{12}_4$. Likewise, the "patch" 11 is surrounded by helices $\mathbf{12}_2$, $\mathbf{12}_5$, $\mathbf{12}_3$, $\mathbf{12}_6$ and the "patch" 11 is surrounded by helices $\mathbf{12}_4$, $\mathbf{12}_3$, $\mathbf{12}_7$, $\mathbf{12}_8$, these helices being positioned as mentioned above, at the four corners of each "patch", with common helices for the adjacent "patches". In this case also, the radiation patterns of the array of "patches" and of the helices constituting the compensating means must be substantially equivalent and are calculated as mentioned above.

FIG. 3*c* represents another embodiment in which four arrays of four "patches" of the type of that represented in FIG. 3*b* are used. In this case, the compensating means consists of a helix 21 positioned as in the case of FIG. 3*b*. Furthermore, an additional helix 22 is placed at the point C centre of the array of 4×4 "patches".

Figure 3E:
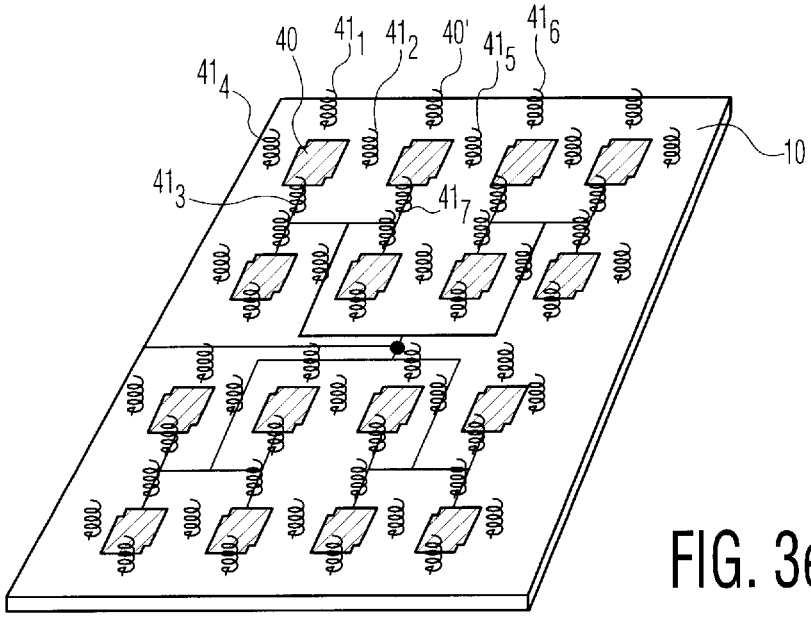

An additional embodiment of a device in accordance with the present invention is represented in FIG. 3*e*. In this case, four arrays of four "patches" of the type of that represented in FIG. 3*b* have been made on a substrate 10. In the embodiment of FIG. 3*e*, the compensating means consist of an array of helices. However, the helices are positioned in the middle of the sides of each "patch". Thus, more specifically, the "patch" 40 is surrounded by four helices $\mathbf{41}_1$, $\mathbf{41}_2$, $\mathbf{41}_3$, $\mathbf{41}_4$ placed respectively in the middle of each of the four sides, the "patch" 40' is also surrounded by four helices $\mathbf{41}_2$, $\mathbf{41}_5$, $\mathbf{41}_6$, $\mathbf{41}_7$ and so on and so forth for the other "patches". The radiation patterns of the "patches" and of the helices are obtained as mentioned above.

More generally, in the circuits described above, the adjusting of the amplitude and of the phase of the field radiated by the compensating means, may be achieved by adjusting one or more of the following elements:

The level of coupling of the helix or helices to the printed antenna

The directivity of the latter

The length of the support rod and/or of the load at the tip of the helix

The position of the helices

The angular rotation of the helices with respect to their axis

Figure 4:
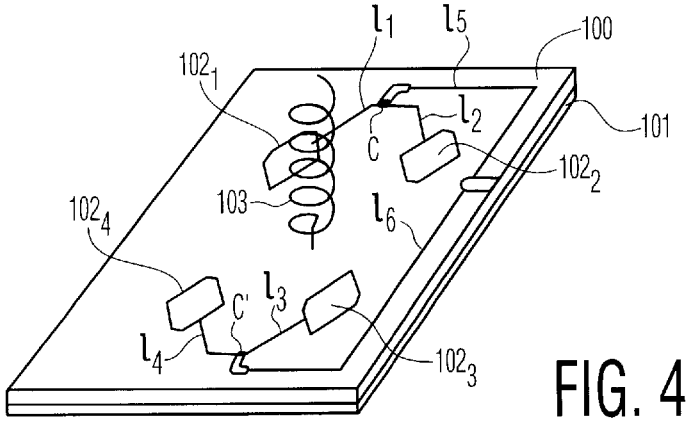
FIG. 4 is a diagrammatic perspective view of a preferred embodiment of the invention.
Figure 5:
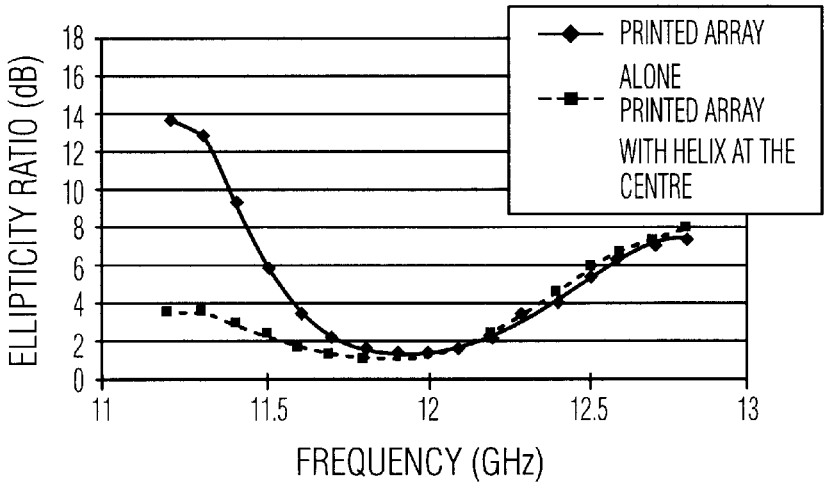
FIG. 5 is a curve giving the ellipticity ratio as a function of frequency in the case of a printed array alone or of an array furnished with means in accordance with the present invention.

A particular embodiment of a device for transmitting and/or receiving electromagnetic waves comprising a compensating element, namely a means dimensioned and positioned with respect to the radiating element in such a way as to radiate at the frequency of the radiating element a circular polarization of opposite sense to that of the radiating element so as to compensate for the cross component of the radiating element, will now be described with reference to FIGS. 4, 5 and 6, in accordance with the present invention. Represented in FIG. 4 is a printed antenna operating at 12 GHz. This printed antenna consists of an array of four "patches" $\mathbf{102}_1$, $\mathbf{102}_2$, $\mathbf{102}_3$, $\mathbf{102}_4$ made on a substrate 100 furnished on its lower face with a metal layer 101 forming an earth plane. As represented in FIG.4, the "patch"$\mathbf{102}_1$, and the "patch" $\mathbf{102}_2$ are together connected to the feed circuit made in microstrip technology. More specifically, the "patch" $\mathbf{102}_1$ is connected to the point C by a length L1 while the "patch" $\mathbf{102}_2$ is connected to the point C by a length L2. In an identical manner, the "patch" $\mathbf{102}_4$ is connected to the point C' by a length L4 and the "patch" $\mathbf{102}_3$ is connected to the point C' by a length L3. The points C and C' are connected to the input A of the feed circuit respectively by a length L5 and a length L6. The four "patches" $\mathbf{102}_1$, $\mathbf{102}_2$, $\mathbf{102}_3$, $\mathbf{102}_4$ forming a sequential array, the various lengths L1, L2, L3, L4 as well as L5 and L6 have dimensions which are well known to the person skilled in the art so as to obtain the necessary phase shifts on the various "patches". The equations giving these lengths will not be given again below.

Figure 6A:
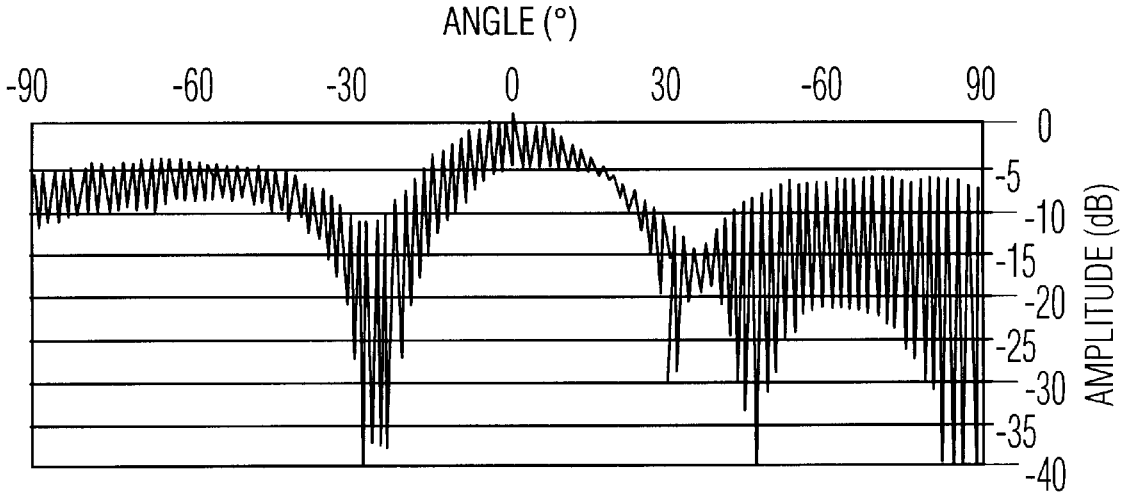
FIGS. 6*a* and 6*b* depict the radiation pattern of the radiating elements respectively in the case of an array alone and in the case of an array furnished with means in accordance with the present invention.
Figure 6B:
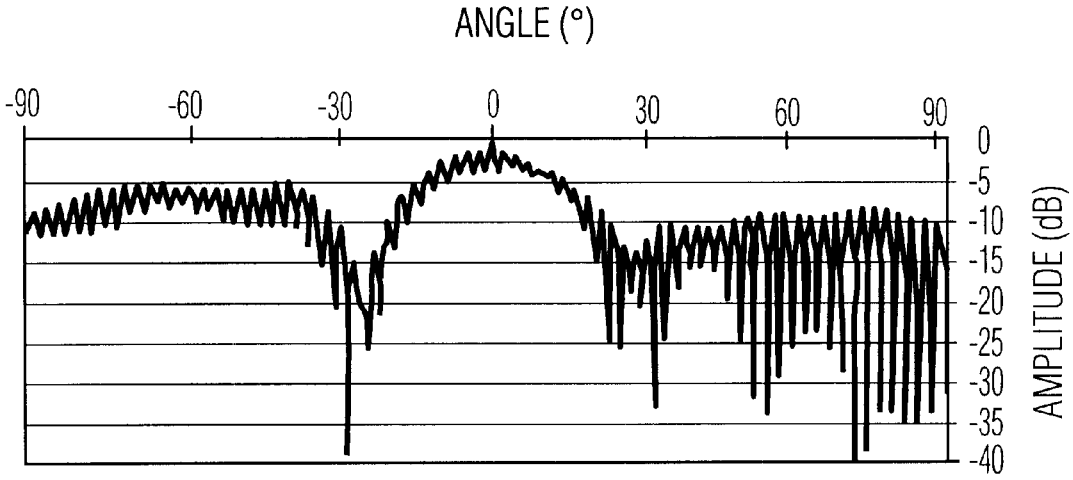

In accordance with the present invention, the compensating means consists of a radiating element of the travelling wave type, more especially of a helix 103 which is planted in the substrate at the centre of the array, namely symmetrically with respect to the four "patches" $\mathbf{102}_1$, $\mathbf{102}_2$, $\mathbf{102}_3$, $\mathbf{102}_4$. Represented in FIG. 5 is the ellipticity ratio as a function of the frequency of the printed antenna of FIG. 4. Thus, in this case, for a fixed maximum ellipticity ratio of 2 dB, the frequency band of the printed antenna goes from 430 MHz, in the absence of the helix, to 628 MHz in the presence of a correctly dimensioned helix. In the case of this particular embodiment, the parasitic helix affords an increase of 46% in the frequency bandwidth of the array. Moreover, FIGS. 6*a* and 6*b* show the improvement in the quality of the circular polarization as a function of the angle of observation with respect to the principal direction of the beam. This is given by the radiation patterns of the printed array in the presence of a parasitic helix, namely FIG. 6*b* and in the absence of the parasitic helix, see FIG. 6*a*. These radiation patterns reveal a sharp improvement in the quality of the circular polarization in a wide sector of angles.

Figure 7:
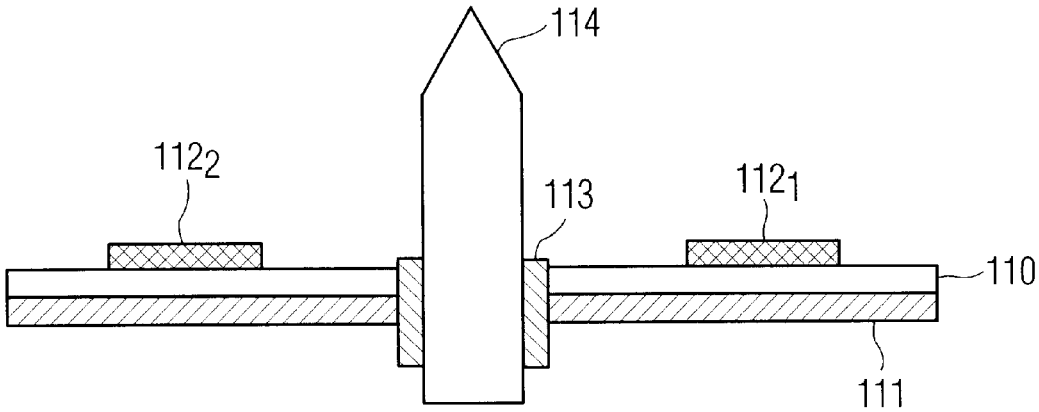
FIG. 7 is a diagrammatic sectional view of another embodiment of the present invention.

Represented in FIG. 7 is another embodiment of the compensating means. In this case, the printed antenna consists in a known manner of an array of "patches" $\mathbf{112}_1$, $\mathbf{112}_2$ made on a substrate 110 furnished with an earth plane 111. This array of "patches" can radiate a linear polarization (for example horizontal linear) or circular polarization (for example right circular). In the middle of the array of "patches" $\mathbf{112}_1$, $\mathbf{112}_2$ has been positioned a radiating element of the travelling wave type consisting of a dielectric rod 114 also referred to as a polyrod, mounted in a socket 113. The polyrod is dimensioned so as to radiate a polarization orthogonal to that of the array of patches (in this instance vertical linear in the case of a linear polarization or left circular in the case of a circular polarization). The simulations carried out with a device of this type have shown that the undesired cross component radiated by the array of "patches" excites the polyrod which in turn radiates a field whose phase can be adjusted in such a way that it fully or partly opposes the cross component of the printed antenna thus improving the purity of the circular polarization radiated by the antenna.

Thus, the invention makes it possible to obtain a printed antenna radiating a circularly or linearly polarized wave over a widened frequency band.

Furthermore, in the case of circular polarization, its use with the technique of sequential rotation furthermore allows the widening of the frequency band, and makes it possible to improve the quality of the circular polarization for different angles of the principal direction of the beam.

It is quite cheap to implement. It offers great flexibility of adjustment.

What is claimed is:

1. Device for transmitting and/or receiving electromagnetic waves comprising at least one printed-type antenna for radiating a circular or linear polarization of given sense, said polarization presenting a cross component, comprising at least one passive means dimensioned and positioned with respect to the printed-type antenna in such a way as to radiate, at the frequency of the printed-type antenna, a circular or linear polarization of opposite sense to that of the printed-type antenna and whose phase is adjusted so as to compensate for the cross component of the printed-type antenna.

2. Device according to claim 1, wherein the printed-type antenna comprises a patch, a slot, a dipole, an array of n patches, of n dipoles, of n slots, the antenna being excited in such a way as to obtain a circular or linear polarization of given sense.

3. Device according to claim 1, wherein the means dimensioned and positioned with respect to the printed-type antenna in such a way as to radiate, at the frequency of the printed-type antenna, a circular or linear polarization of opposite sense to that of the printed-type antenna and whose phase is adjusted so as to compensate for the cross component of the printed-type antenna includes a radiating element of the travelling wave type.

4. Device according to claim 3, wherein the radiating element of the travelling wave type is chosen from among the dielectric rods and helices associated with polarizers.

5. Device according to claim 3, wherein the radiating elements of the travelling wave type are positioned symmetrically with respect to the printed-type antenna.

6. Device according to claim 5, wherein the radiating elements of the travelling wave type are positioned at the four corners of printed-type antenna.

7. Device according to claim 5, wherein when the transmission/reception device includes an array of n printed-type antennas, the radiating elements of the travelling wave type are positioned at the centre of the array.

* * * * *